US007917968B2

(12) United States Patent
Roux

(10) Patent No.: US 7,917,968 B2
(45) Date of Patent: Apr. 5, 2011

(54) ARMORED GARMENT WITH RESCUE STRAP

(76) Inventor: Phillip D. Roux, Peoria, AZ (US)

( * ) Notice: Subject to any disclaimer, the term of this patent is extended or adjusted under 35 U.S.C. 154(b) by 0 days.

(21) Appl. No.: 12/322,454

(22) Filed: Feb. 2, 2009

(65) Prior Publication Data

US 2011/0055992 A1 Mar. 10, 2011

Related U.S. Application Data

(60) Provisional application No. 61/063,377, filed on Feb. 1, 2008.

(51) Int. Cl.
*F41H 1/02* (2006.01)
*F41H 1/00* (2006.01)

(52) U.S. Cl. ..... 2/2.5

(58) Field of Classification Search ..... 2/2.5
See application file for complete search history.

(56) References Cited

U.S. PATENT DOCUMENTS 4,211,218 A * 7/1980 Kendrick ..... 602/19
4,422,454 A * 12/1983 English ..... 128/870
4,593,788 A * 6/1986 Miller ..... 182/3
5,027,833 A * 7/1991 Calkin ..... 128/870
5,220,976 A * 6/1993 Gunter ..... 182/3
5,531,292 A * 7/1996 Bell ..... 182/3
5,584,737 A * 12/1996 Luhtala ..... 441/107
5,617,582 A * 4/1997 Burwell ..... 2/102
5,754,982 A * 5/1998 Gainer ..... 2/2.5
6,659,689 B1 * 12/2003 Courtney et al. ..... 405/186
7,610,641 B2 * 11/2009 Frost ..... 5/628
2003/0146348 A1 * 8/2003 Douglas et al. ..... 244/151 R
2004/0023574 A1 * 2/2004 Calkin ..... 441/125
2004/0027751 A1 * 2/2004 Goerke et al. ..... 361/90
2005/0179244 A1 * 8/2005 Schroth ..... 280/808
2006/0253950 A1 * 11/2006 Kerr ..... 2/2.5
2006/0288466 A1 * 12/2006 Bucheit ..... 2/102
2009/0211000 A1 * 8/2009 Roux ..... 2/462

* cited by examiner

*Primary Examiner* — Bobby H Muromoto, Jr.
(74) *Attorney, Agent, or Firm* — Craig Weiss; Jeffrey D. Moy; Weiss & Moy, P.C.

(57) ABSTRACT

An armored garment, such as a vest, has an attached rescue strap allowing a soldier in battle to quickly move a fallen comrade from immediate danger to safety. The rescue strap enables a rescuing soldier to move a wounded soldier in a manner that also allows the rescuing soldier to use his weapon and return enemy fire as necessary. The rescue strap may be affixed to an anchor strap secured to a panel of the garment and that distributes the pulling force across the garment panel. The rescue strap stores when not in use, but in a manner easily reached for quick deployment. A pull handle, for example a ring or a carabiner, can be affixed to an end of the strap to be grasped by a rescuing soldier. Pulling the handle draws the rescue strap from its storage location to be used to pull a wounded soldier to safety. A further feature of the armored garment is a stretchable flexible expansion joint that divides an outer woven back panel of the garment allowing greater freedom of movement to the wearer.

17 Claims, 13 Drawing Sheets

ARMORED GARMENT WITH RESCUE STRAP

CROSS REFERENCE TO RELATED APPLICATIONS

This application claims priority from the provisional patent application Ser. No. 61/063,377 filed Feb. 1, 2008, in the name of Phillip D. Roux, entitled "Armored Vest with Rescue Strap," incorporated herein by reference.

FIELD OF THE INVENTION

The present invention relates to armored or ballistic resistant garments including armored vests. More particularly the present invention relates to an armored garment that includes a rescue strap for use in recovering wounded combatants during live fire combat.

BACKGROUND OF THE INVENTION

Ballistic resistant garments and particularly vests have become standard equipment in many law enforcement offices and military units. These garments typically have a fabric shell, usually of a woven material, and contain compartments in the form of pockets. The shell of such garments generally encircles the torso of a wearer and contains panels of impact absorbing anti-ballistic material such as KEVLAR material, KEVLAR being a registered trademark of E.I. Du Pont, Inc. Such garments and in particular vests are generally designed so that the torso of the wearer is surrounded, at least from the neck to the waist, with the protective panels. The vests are commonly known by the public as bullet proof vests, and by the law enforcement community as body armor or protective vests. Ballistic resistant garments resist and usually prevent penetration by most small arms bullets when worn. In the discussions following, "soldier" is referred to, but with the understanding that the combatant may be a police officer, guard or other lawful combatant. Also, although the protective vest is ordinarily thought of in connection with body armor, the garment can have another configuration, e.g. that of a shirt, outer coat, etc.

Recent combat experience has identified a problem that arises in combat. During live fire engagements with an enemy, when one soldier has been wounded and has fallen, his comrades will attempt to drag the fallen soldier out of danger to a position of safety where the soldier can receive medical attention and evacuation. Doing so, however, leaves the rescuing soldier himself open to enemy fire. Typically the rescuing soldier takes his attention off the enemy, bends down, and grasps the fallen soldier to drag the fallen soldier out of the line of fire. Often the rescuing soldier must also lower his weapon and swing it to his side or back in order to hold and move his comrade. If the rescuer needs two hands to grab and move his comrade, such as when the badly wounded soldier must be carefully moved, the rescuing soldier must free both hands from his weapon by swinging it clear. A downed soldier is typically grasped and pulled by any convenient means such as an arm, leg, clothing, or even an edge of the armored vest. In so doing, even quickly, the rescuing soldier often will cease firing his own weapon and take his attention away from the enemy. However, an enemy can continue firing upon the wounded and the rescuing soldier, and the rescuing soldier will need to depend on other soldiers in his squad to maintain covering fire on the enemy. Additionally, during the rescue, the rescuing soldier's weapon is taken out of fire momentarily and the squad's fire power is then lessened. Unfortunately, post action reports indicate that rescuing soldiers have themselves been wounded when exposed and vulnerable during the act of rescuing a brother soldier. It would be desired to develop an armored vest that helps avoid these problems.

In the kind of fire fight discussed above, there is also a high premium on moving the wounded soldier to safety very quickly. The wounded soldier may have fallen in an area that is vulnerable to ongoing enemy fire. The enemy may continue to fire into the wounded soldier. In the heat of battle, unless the wounded soldier is quickly moved, he may receive further, even lethal wounds. And the quicker a soldier gets medical attention, the more likely he is to recover. It would be highly desirable, then, to provide a means to move a wounded soldier out of the immediate fire zone very quickly and without denying a rescuing soldier the ability to return fire.

Armored vests also suffer shortcomings in the freedom of movement they allow a wearer. The armor plating, for example, does not provide any significant degree of "give" or flexibility in relation to the wearer. Additionally, the woven material that surrounds and supports the armor plating may not provide adequate "give" to afford sufficient freedom of movement to the soldier. Thus, it would be desirable to provide an improved armored vest that provides increased freedom of movement to the wearer.

The above discussion has focused on difficulties that combat soldiers encounter, but it will be understood that similar problems can be encountered by police personnel and any other lawful combatant group.

There has been identified a need that can be provided by an improved ballistic resistant garment. It would be desired to provide an armored vest or other garment that assists in the removal of a wounded combatant. More particularly it would be desirable for an improved armored garment to allow a rescuer to pull and move a wounded combatant in a manner that allows the rescuer to continue to face the enemy and to fire a weapon. It would also be desirable if an improved armored vest were to allow for increased freedom of movement to its wearer. Embodiments of the present invention address one or more of these needs.

SUMMARY OF THE INVENTION

In accordance with one aspect of the present invention, there is provided a ballistic resistant garment having a rescue strap connected to it and accessible to a rescuer for pulling a fallen combatant out of harm's way. In a preferred embodiment an anchor strap is affixed to a panel of the garment and connects the rescue strap to the garment. The rescue strap may include a pull ring or other handle affixed to a free end of the rescue strap. The handle may be a carabiner allowing quick connection by a rescuer to his clothing or gear. The ballistic resistant garment of one embodiment may also have an attaching ring or other connector that connects the anchor strap to the rescue strap. Alternatively the rescue strap and anchor strap may be integrally formed of a single strap, one portion being securely fastened to the protective garment and the other being free for the rescuer to grab. The anchor strap, in any event, may be a fabric strap and it and the rescue strap may each define or include a fabric loop for connection to an attaching ring interconnecting them. Preferably the rescue strap is stored such that the pull ring or other handle is exposed and available to a rescuer and the remainder of the strap is contained inside the garment. The garment can have a slit or other opening through which the rescue strap can pass as it is withdrawn by a rescuer for use in moving a down colleague.

In one preferred embodiment of the invention a soldier's freedom of movement in a ballistic resistant garment such as an armored vest is enhanced by an expansion joint of stretchable, flexible material interconnecting and allowing movement of sections of the material of the outer shell of the vest. Preferably the expansion joint is a strip of material sewn to adjoining sections of the outer material of the vest and extending centrally along the back of the wearer.

Other features and advantages of ballistic resistant garments of the invention will become apparent from the following detailed description, taken in conjunction with the accompanying drawings which illustrate, by way of example, the principles of the invention through one or more preferred embodiments.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding Background of the Invention, Brief Summary of the Invention or this Detailed Description of the Invention. By way of example the exemplary detailed description of preferred embodiments refers to armored vests but the invention may readily be applied to other ballistic resistant or armored garments as mentioned above.

Figure 1:
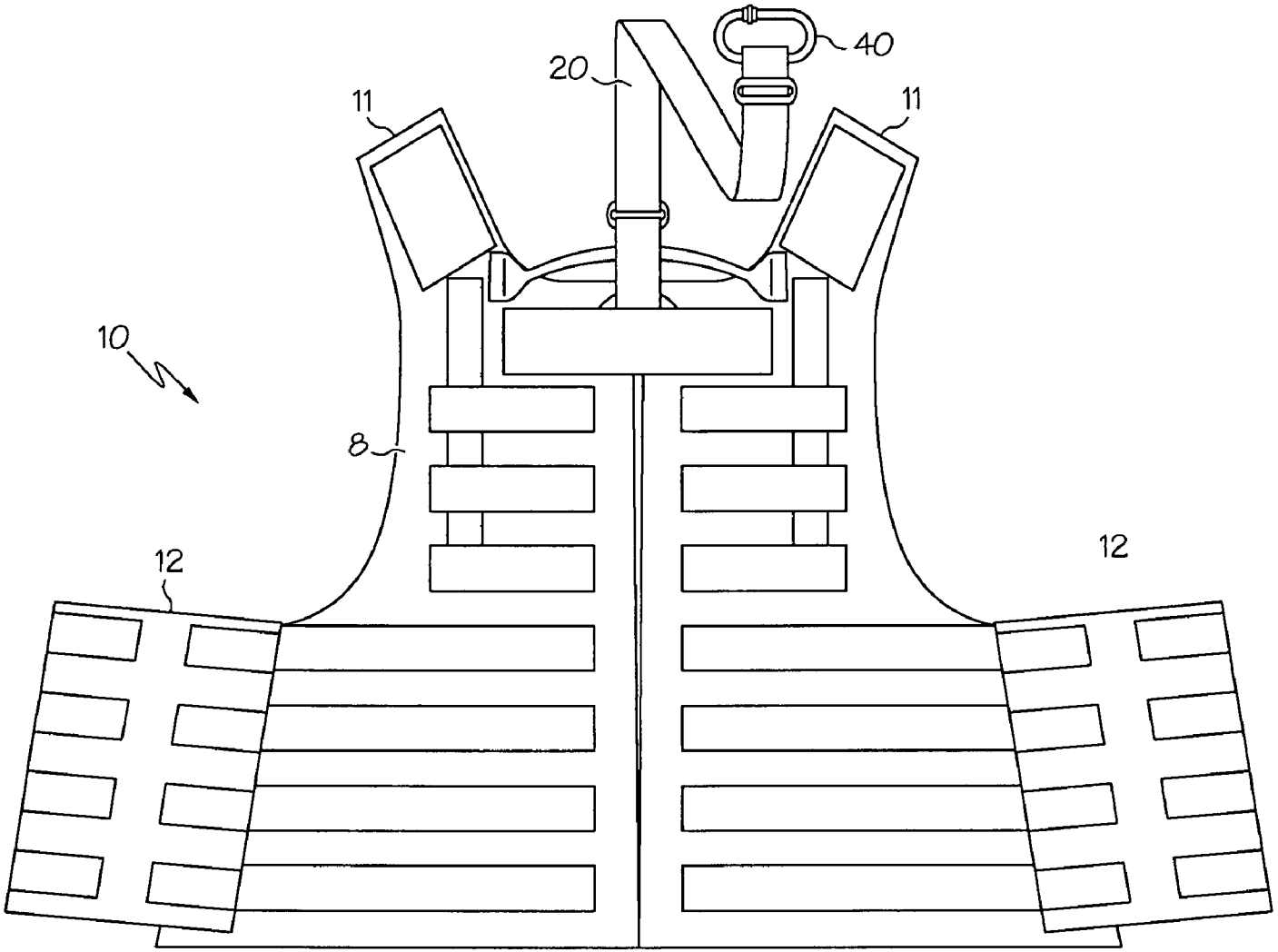
FIG. 1 is a plan view of an armored vest back with a rescue strap according to an embodiment of the present invention.

Referring to FIG. 1, there is shown a back part 8 of an armored vest 10 with a rescue strap 20. In FIG. 1 just the back half of vest 10 is illustrated. As is known in the art, this is the vest back which is combined with a similarly configured front to complete the vest 10 and cover the wearer's torso. Shoulder straps 11 and side straps 12 hold the vest 10 in place on the wearer, joining the front and back. Also, as is known in the art, the vest 10 includes interior compartments, pockets or other means within which anti-ballistic panels are secured. Also, the vest 10 may include additional pockets or pouches for miscellaneous equipment. The vest 10 may include a pouch to contain a water storage bladder (not shown), such as a CAMELBACK® bladder. (FIGS. 9 through 13 show a CAMELBACK® tube extending (at 19 in FIG. 9) from the vest 10 as would be used by a soldier for hydration in the field.)

Figure 2:
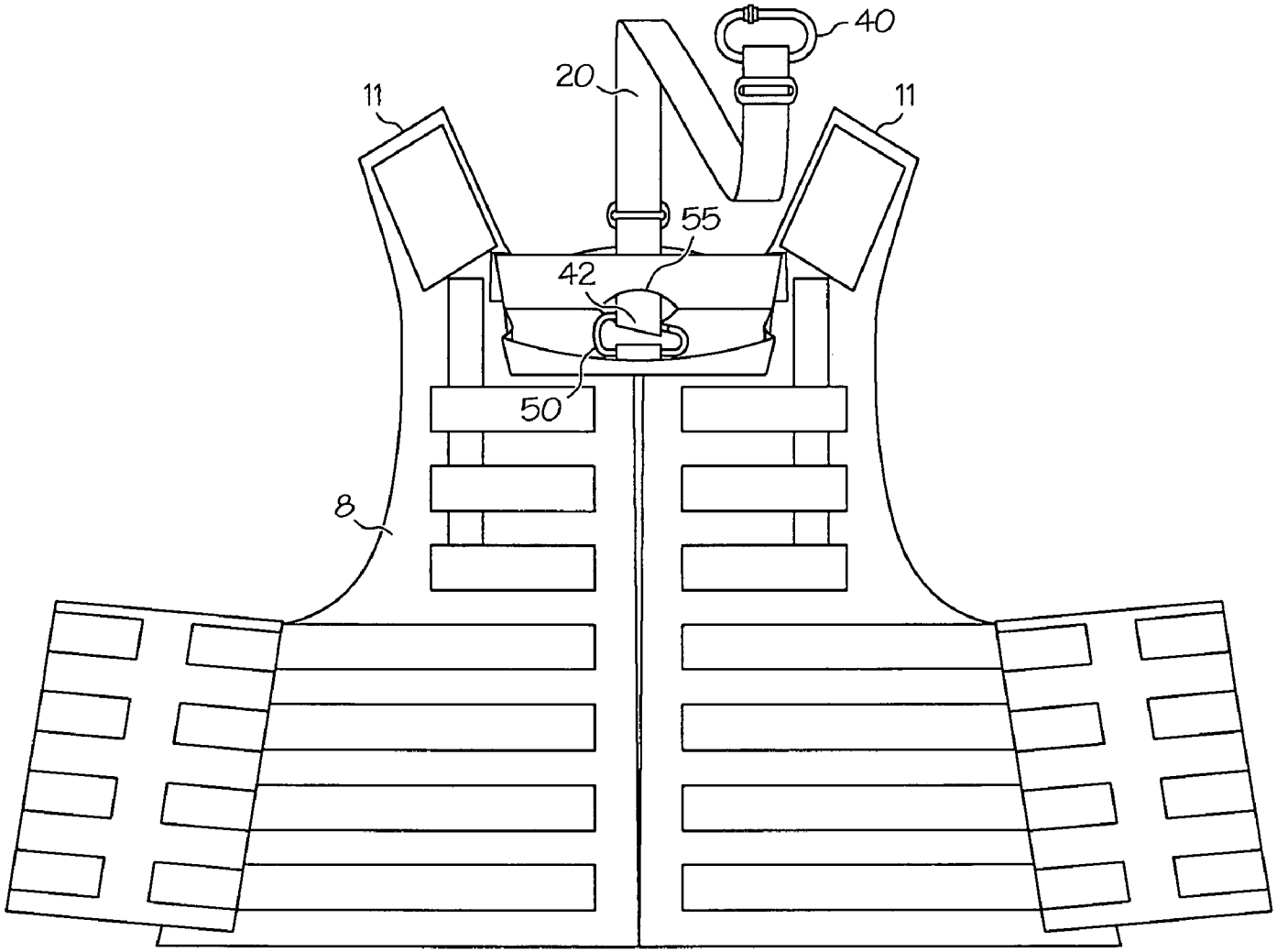
FIG. 2 is an enlarged fragmentary view of a rescue strap attached to an armored vest back according to the embodiment of FIG. 1.

FIG. 1 also shows a rescue strap 20 extending from the vest back 8. In a preferred embodiment, the strap 20 is a length of flexible web or strap-like material. A handle 40 such as a pull ring or carabiner may be attached to one end of the strap 20. The handle 40 is preferably formed and sized so that one's hand can readily grasp and pull on the handle. In the preferred embodiment illustrated, the handle is a carabiner as shown better in FIGS. 2 and 3. An advantage of the carabiner is that the carabiner can be quickly attached to some other item, for example some part of a rescuing soldier's clothing or gear. By securing the carabiner to his clothing or gear, the rescuing soldier can, by walking or crawling, pull the rescue strap 20 and fallen soldier without having to use his hands at all. Thus the rescuing soldier's hands can remain free for other uses such as using his weapon.

Referring again to FIG. 2, one preferred method of attaching the rescue strap 20 is illustrated. In this embodiment the rescue strap 20 has an attaching ring 50 (or other connection hardware) affixed to a second end of the strap remote from the handle 40 by a loop 42 formed in the strap 20 and encircles a part of the ring 50. The ring 50 is also affixed to a portion of the vest itself, as by a fabric loop 75 encircling a part of the ring and connected to a vest panel.

Figure 3:
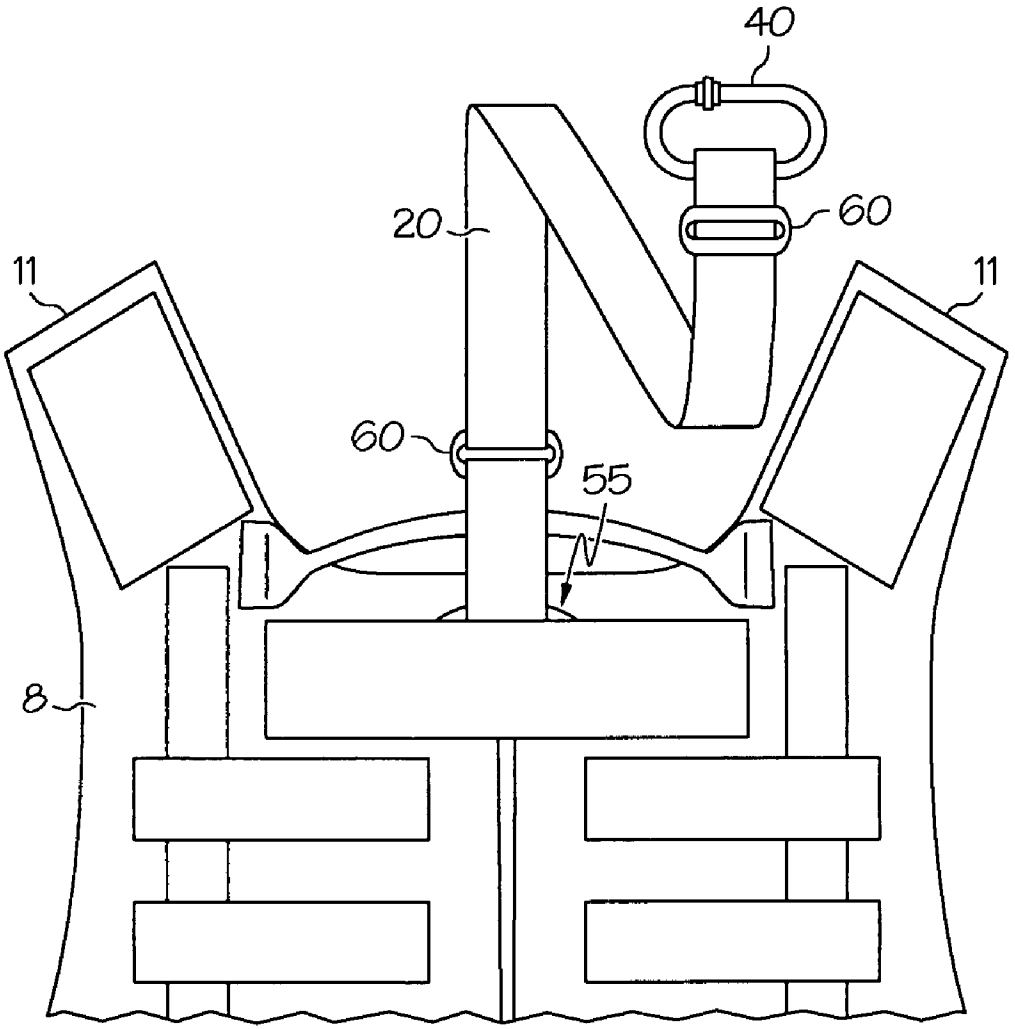
FIG. 3 is a further enlarged fragmentary view of a rescue strap attached to an armored vest back according to the embodiment of FIG. 1 showing length adjusting provisions.
Figure 4:
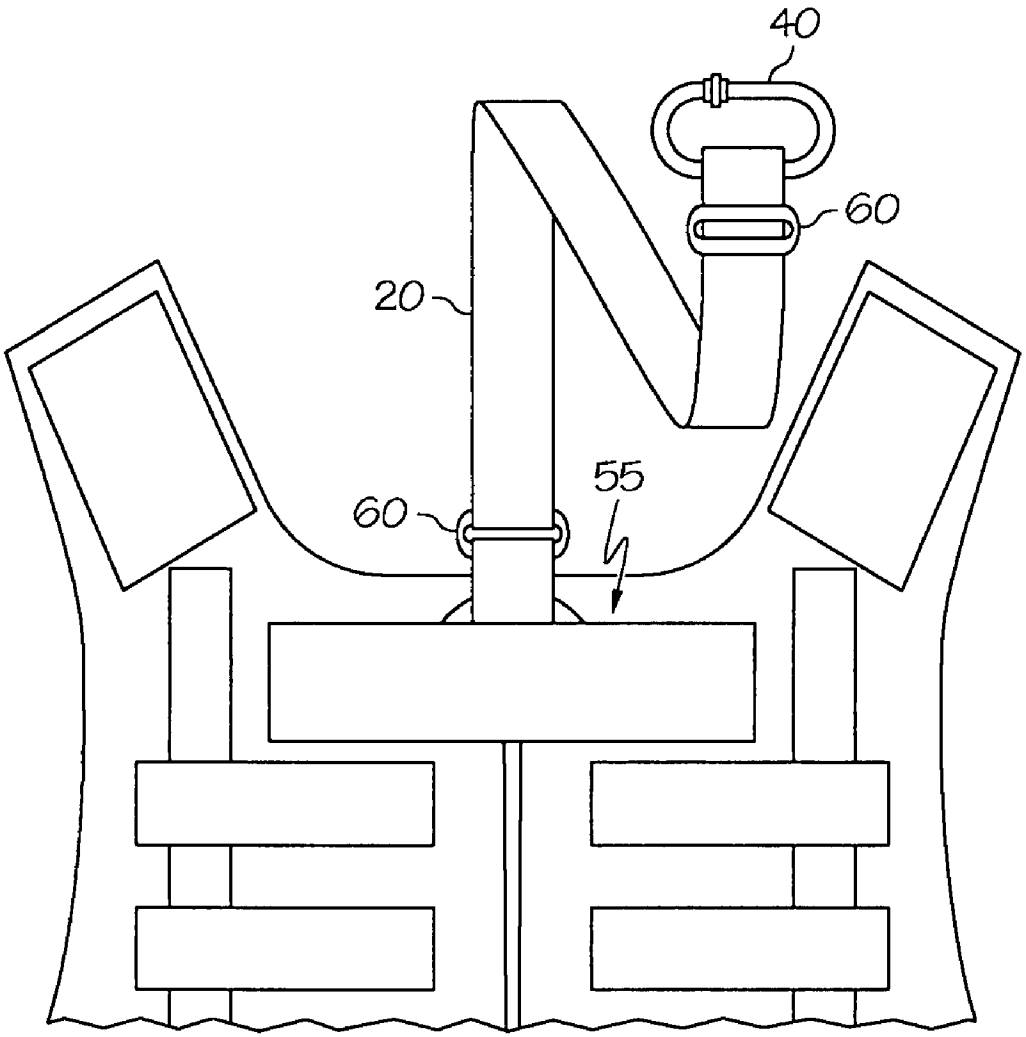
FIG. 4 is another enlarged fragmentary view of a rescue strap attached to the vest like that of FIG. 1 with a carabiner attached as a pull ring.
Figure 5:
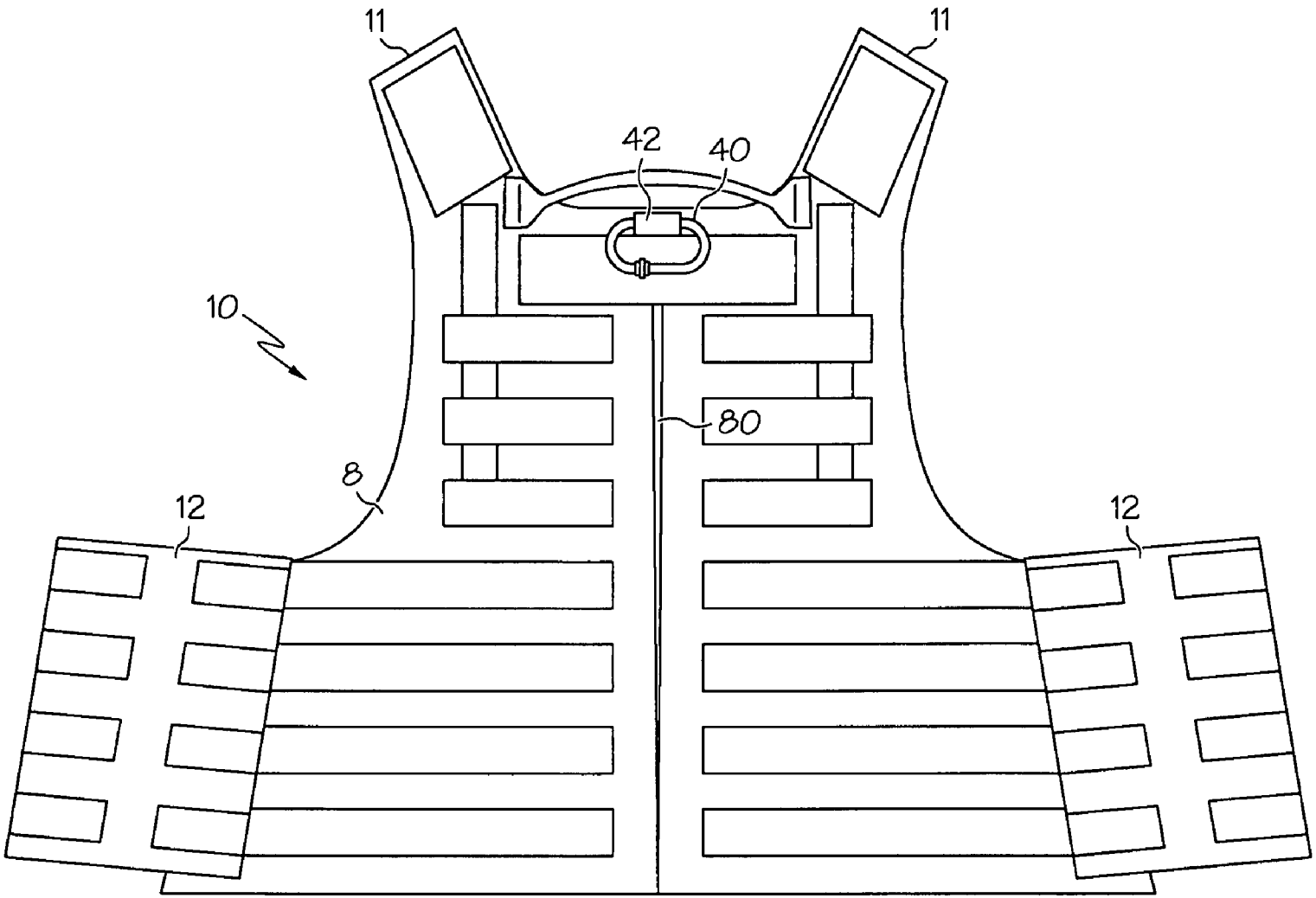
FIG. 5 is a perspective view of the armored vest of FIG. 1 with its rescue strap stored in the interior of the vest and the pull ring exposed.

As seen in FIGS. 3 and 4, the rescue strap 20 may include length-adjusting clips or buckles 60 or other length-adjusting means if desired. Pressing an end of the strap 20 through the clip or buckle 60 may form the loop 42 in a manner well known. The strap 20 extends through an opening or slit 55 (best shown in FIG. 2) and the strap 20 can freely move through the slit 55. FIG. 5 illustrates the vest back 8 with the rescue strap 20 in a stored position. The majority of the length of the strap 20 has been tucked into the interior of the vest back 8 when stored. When stored, the strap material can hang loosely within the vest or, if preferred, it can be held in a pocket or sleeve (neither shown). However, in the stored position the pull ring, or other handle 40, is still accessible outside of the vest 10. Thus a rescuing soldier can grasp the handle 40 when the strap 20 is stored.

Figure 6:
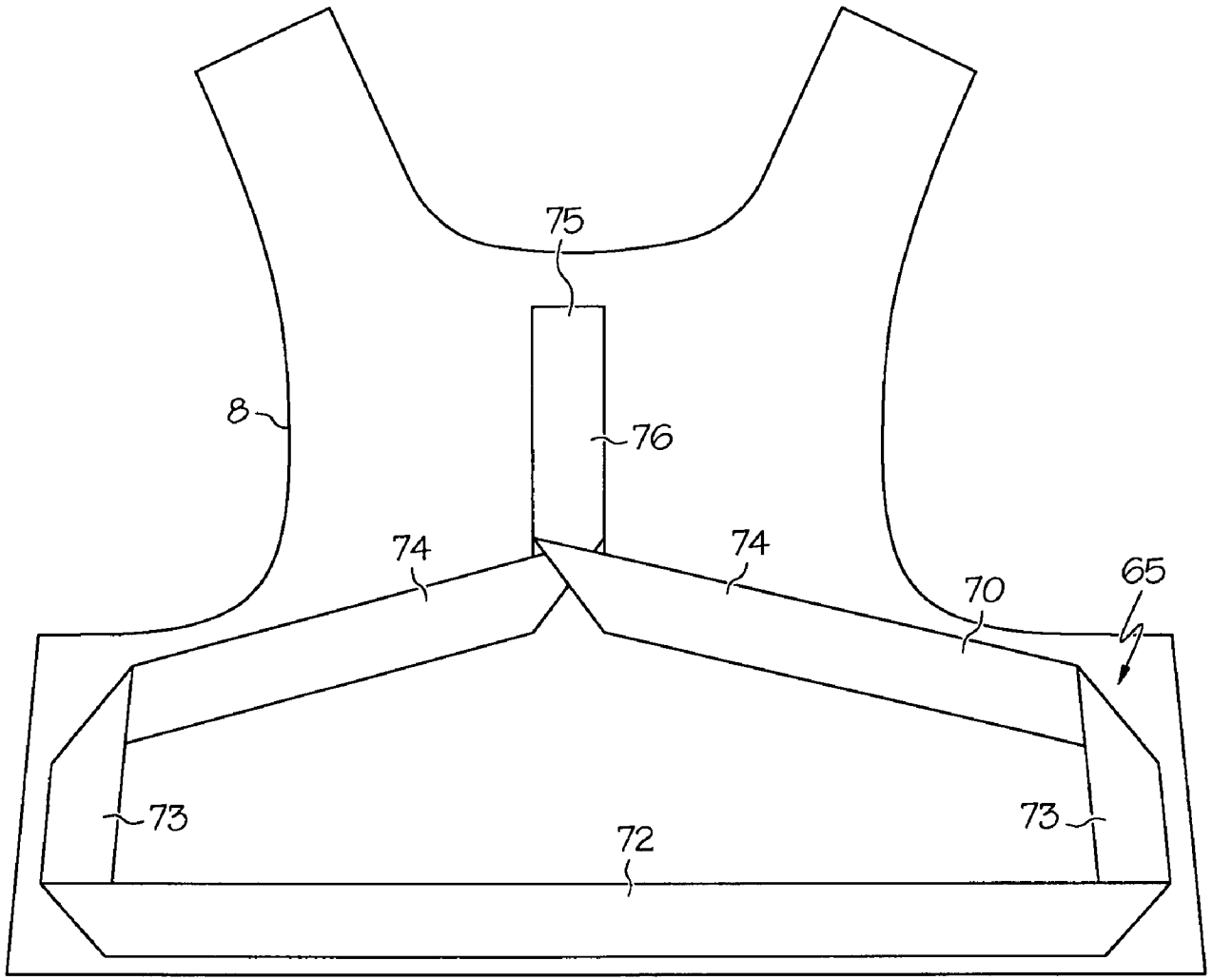
FIG. 6 is a plan view of an inside panel of the armored vest of FIG. 1 illustrating an anchor strap secured to the panel.
Figure 7:
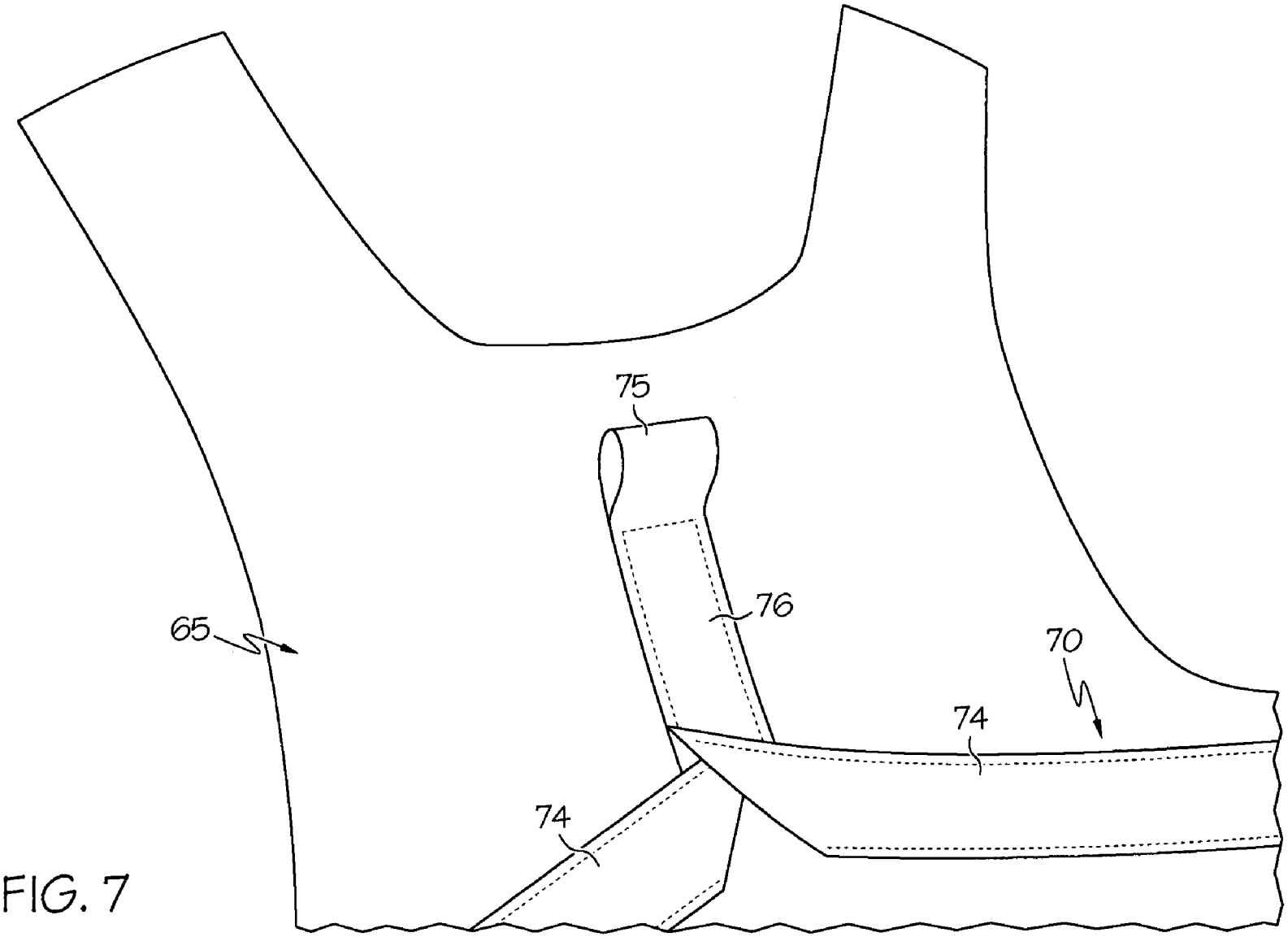
FIG. 7 is an enlarged fragmentary view of a loop forming a portion of the anchor strap shown in FIG. 6.
Figure 8:
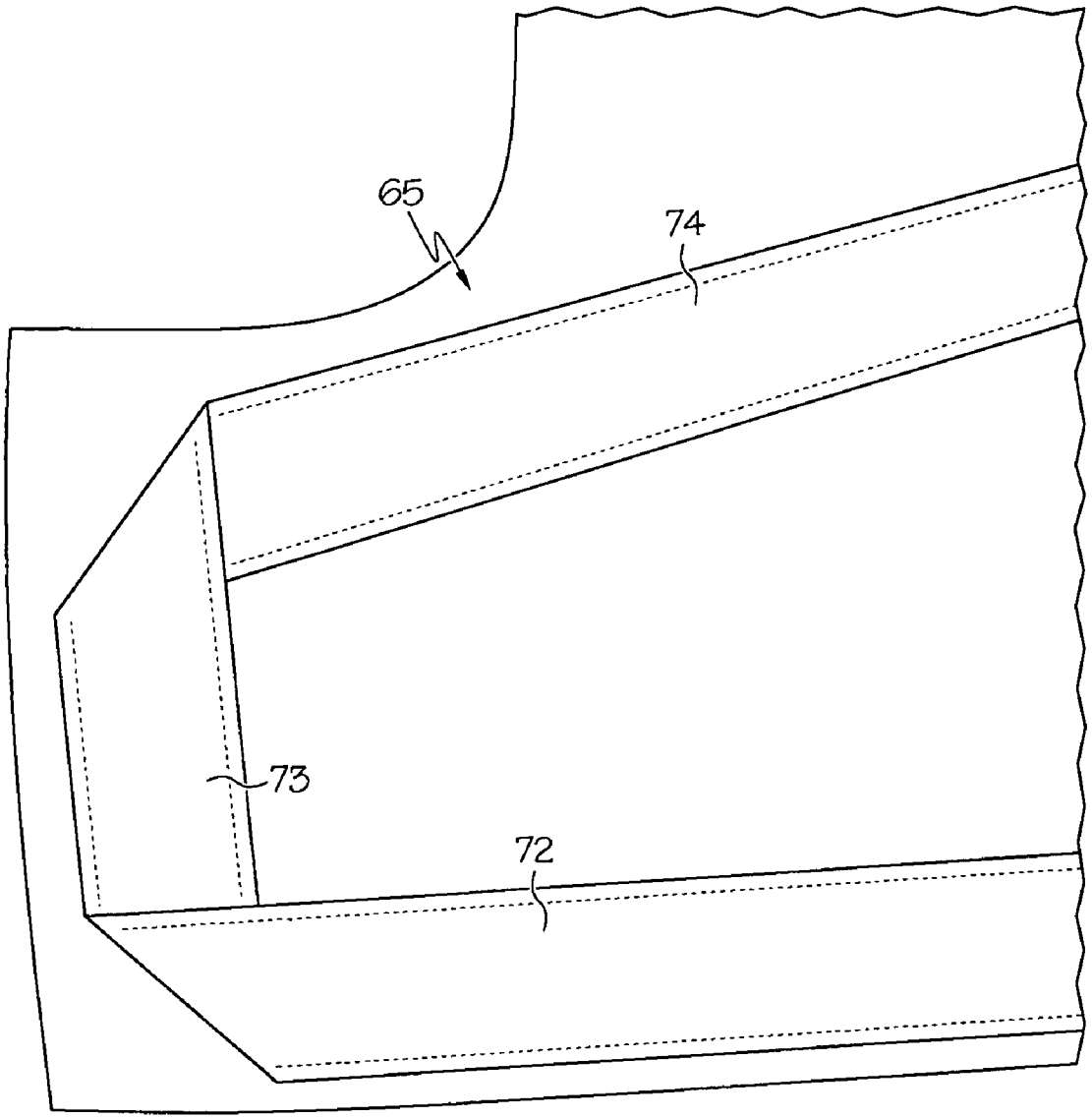
FIG. 8 is a further enlarged fragmentary view showing stitching securing the anchor strap to the panel shown in FIG. 6.

Referring next to FIGS. 6, 7, and 8, there is illustrated a preferred embodiment of an anchor strap 70. The anchor strap 70 shown is a length of strap material that is secured to a panel 65 that is part of the fabric shell of the vest back 8. In the illustrated embodiment, the anchor strap 70 is secured to the inside of the vest panel 65 by stitching. Other means of attachment such as rivets or other strong, reliable fasteners or securing means may be used. Various lengths and configurations of the anchor strap 70 can be used. Other preferably flexible materials than the fabric strapping material shown can be used to form the anchor strap 70, provided the material has high tensile strength and is not subject to deterioration. Various cords or steel straps, wires or cables are examples of alternatives. The illustrated preferred embodiment of anchor strap 70 provides a robust and yet not uncomfortable connection to the vest 10. Shown best in FIG. 7 the anchor strap 70 forms the loop 75. The loop 75 can be formed by turning back the end of the strap 70 and stitching it in place. As previously described, an attaching ring 50 can join the loop 75 to the rescue strap 20. The use of the anchor strap 70 shown has an advantage in that it provides a strong and robust attachment of the rescue strap to the body of the vest 10. Such a strong attachment transfers a pulling force effectively with little or no risk of breaking or pulling loose. While it has been noted that the anchor strap 70 can have different configurations, nevertheless the general configuration in the illustrated embodiment is advantageous. The anchor strap 70 has a lower run 72 that extends from a first side of a panel 65 of the shell of the vest back 8 to a second side of that panel. At edges, a pair of vertical runs 73 is affixed and extends upward to adjoining upper runs 74 that meet centrally to form a further pair of overlapped vertical runs 76 terminating in the loop 75. Thus configured and secured to the vest panel 65, the anchor strap 70 distributes pulling force applied at the loop 75 well across the vest panel 65 and the wearer's back, and yet it does not interfere with the wearer's movement or add discomfort.

Figure 9:
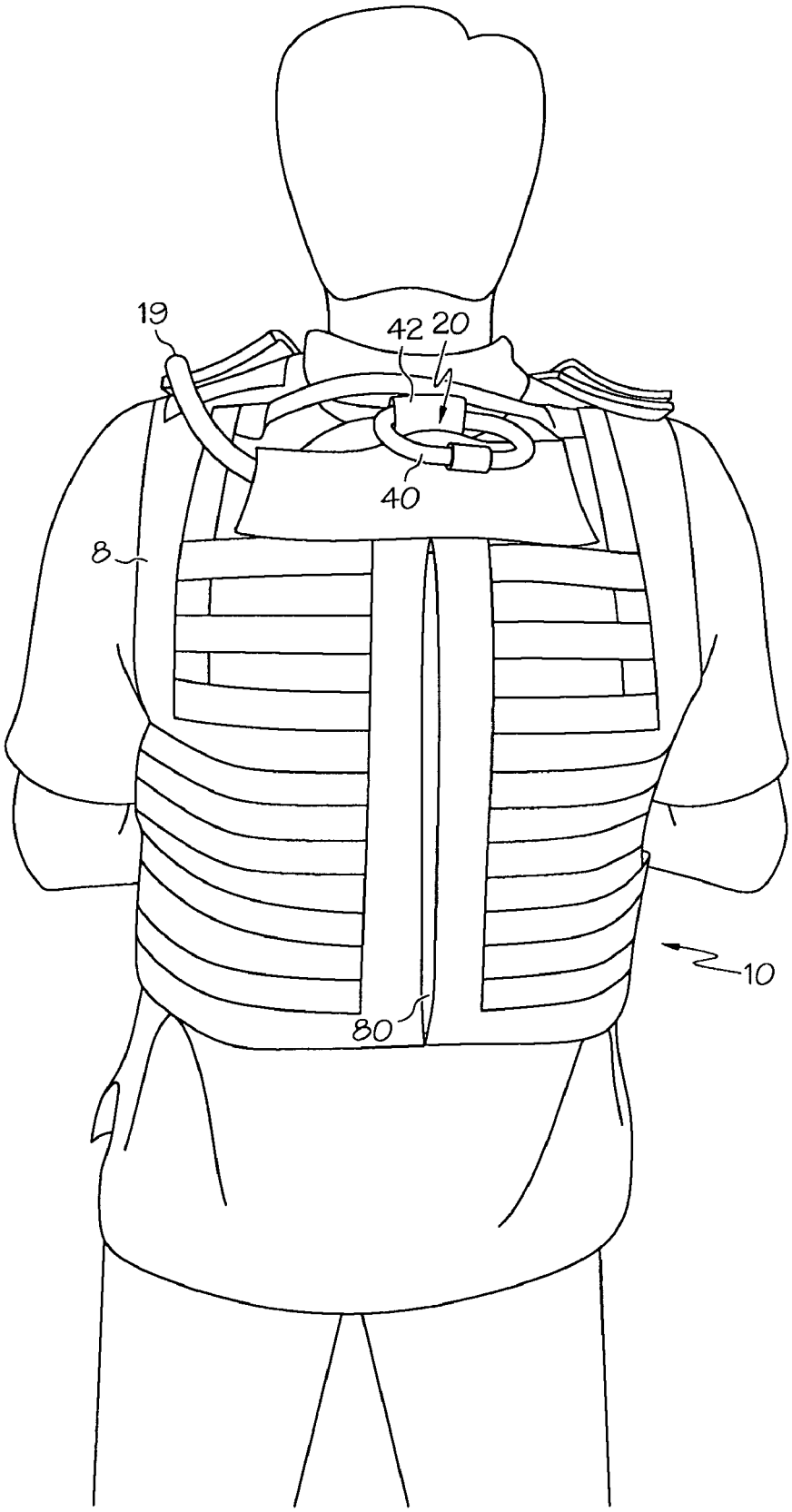
FIG. 9 is a fragmentary rear elevation view showing the armored vest of FIGS. 1-8 on a wearer.
Figure 10:
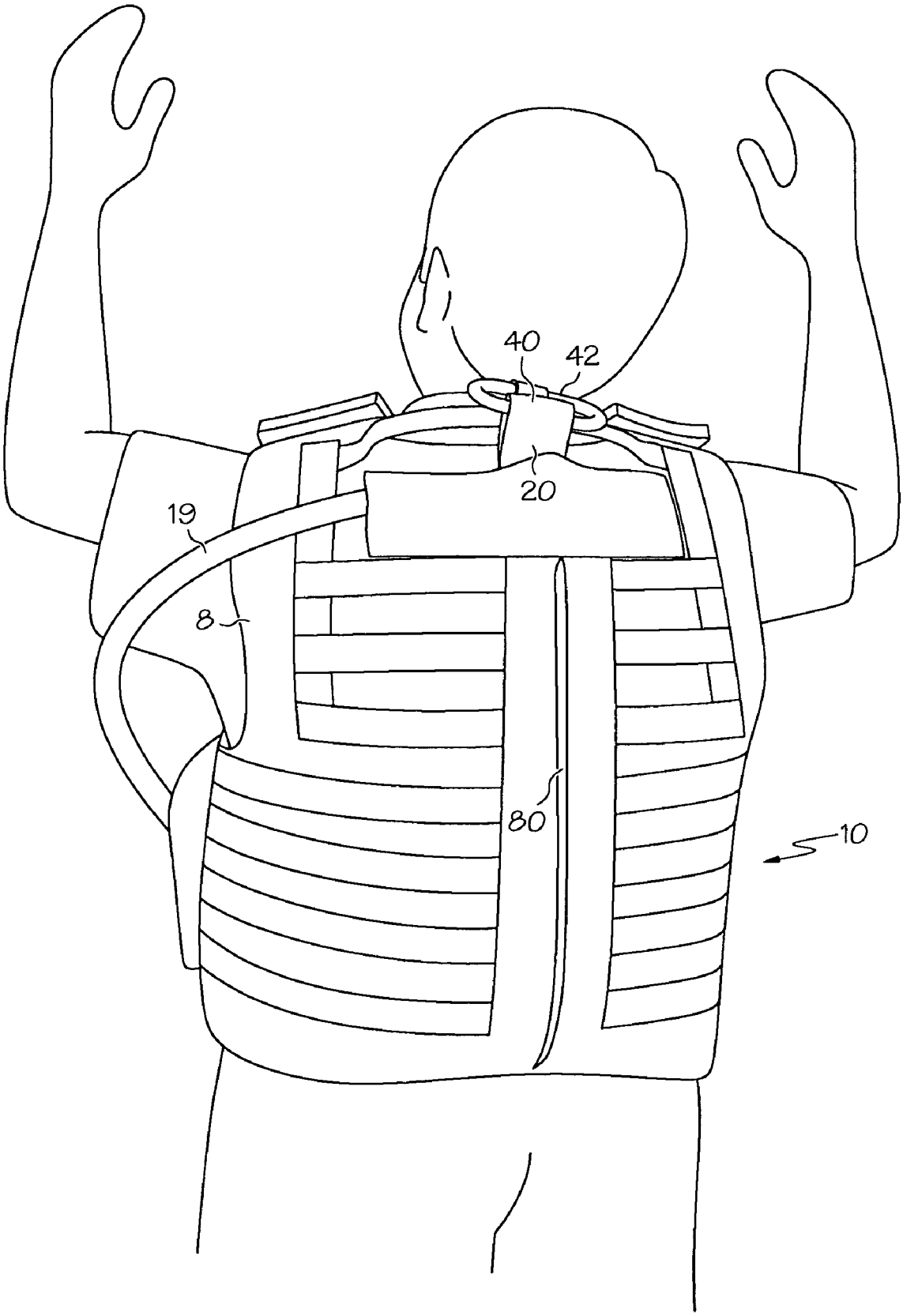
FIG. 10 is a fragmentary top plan view of the armored vest of FIGS. 1-9 on the wearer, now prone.
Figure 11:
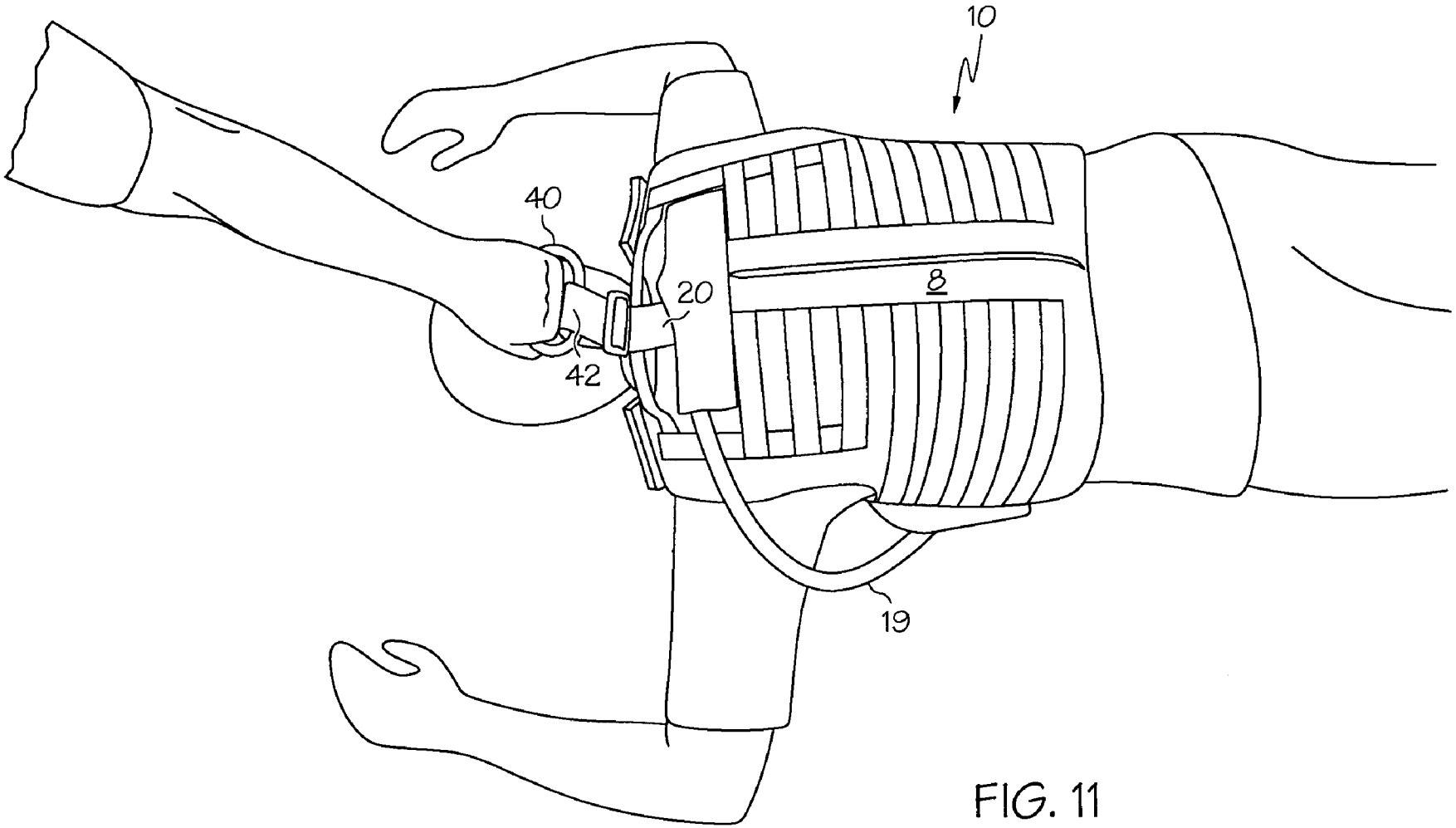
FIG. 11 is a further fragmentary top plan view showing a rescuer's hand grasping the pull ring of a rescue strap according to the embodiment of FIGS. 1-10.
Figure 12:
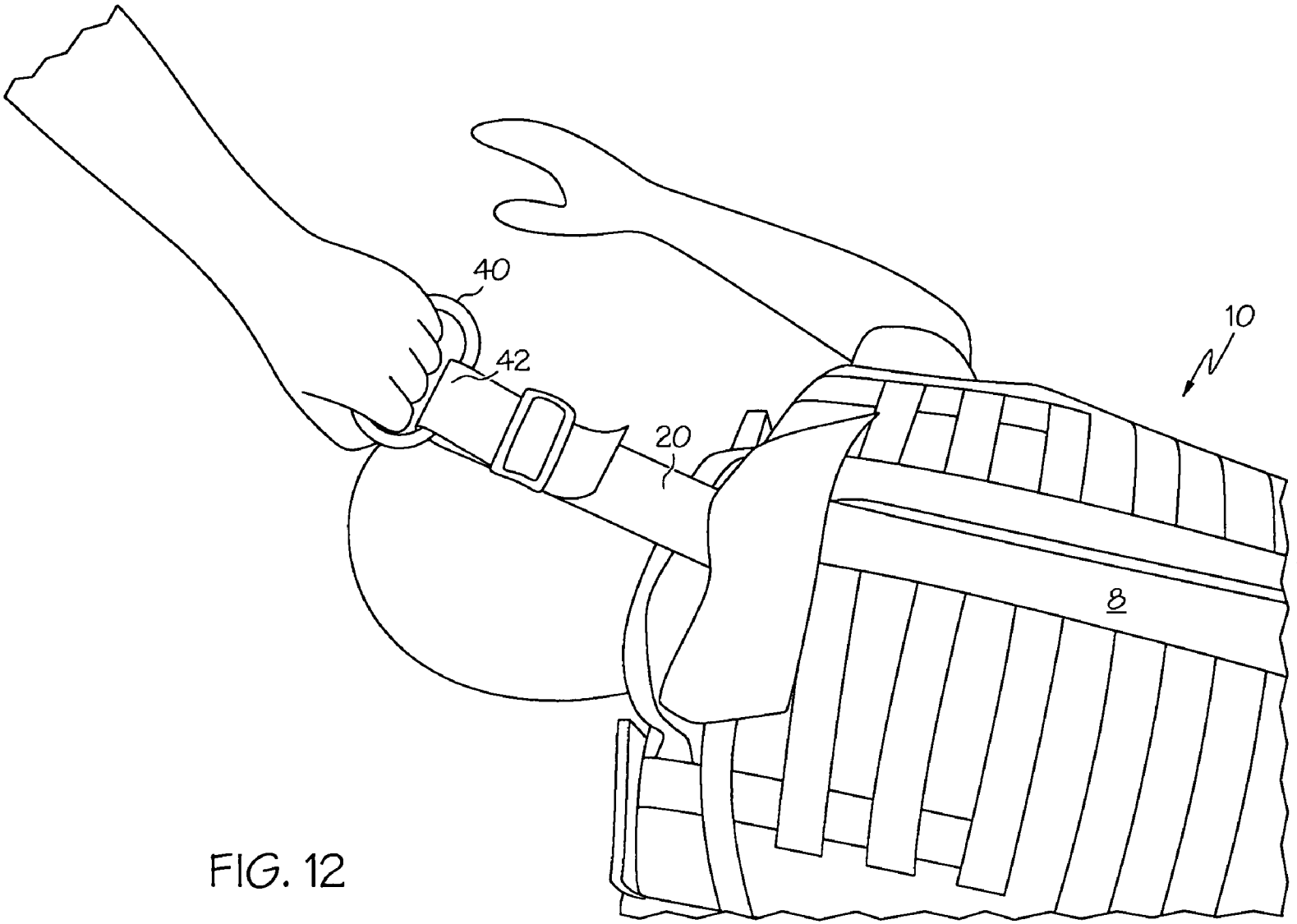
FIG. 12 is a fragmentary top plan view showing a rescuer pulling on the rescue strap of FIG. 11.

Referring now to FIGS. 9 through 13, the use of the armored vest with rescue strap is illustrated. As shown in FIG. 9, the vest 10 is worn in normal fashion. The rescue strap is stored in FIG. 9 such that substantially only the pull ring handle 40 is exposed at the exterior of the vest 10. The rescue strap 20 does not interfere with normal use of the vest 10, including in particular, its ballistic resistance. In FIG. 10 the vest wearer has fallen prone as a wounded soldier might. In FIG. 11 a rescuer has grasped the pull ring handle 40. The rescuer pulls on the pull ring handle 40 as shown in FIG. 12 drawing out the strap 20. The rescue strap 20 has been fully extended and is drawn taught in FIG. 13. Further pulling applies the pulling force to the vest 10 itself via the anchor strap 70 and moves the fallen soldier. The steps illustrated in FIGS. 11 through 13 can occur quickly in a single fluid motion. The rescue strap 20 passes easily through the slit 55 from within the vest interior where it has been stored loosely.

Figure 13:
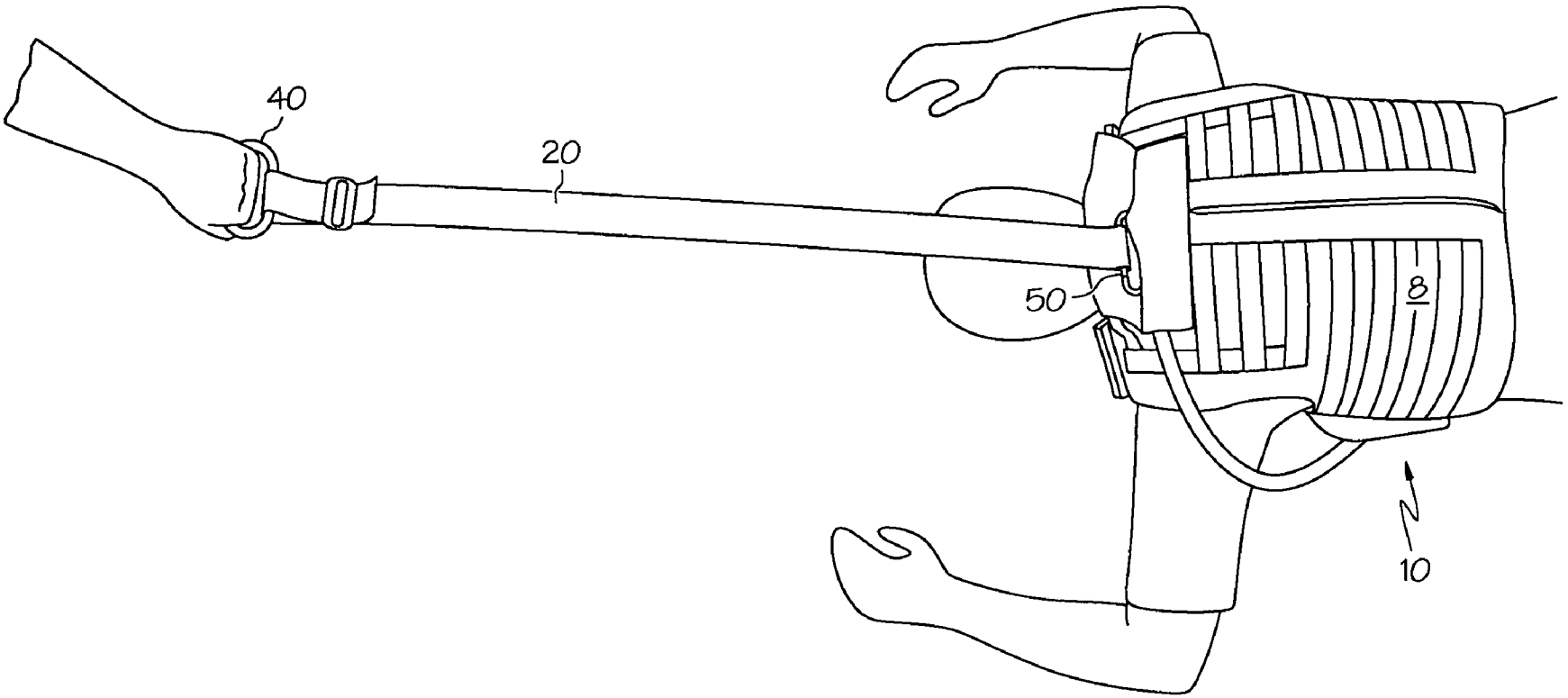
FIG. 13 is a fragmentary perspective view showing a rescuer moving a fallen colleague by pulling on a pull ring of a fully extended rescue strap of the vest of FIGS. 1-12.

Rescue strap 20 can have any desired length. However, it is preferred that the rescue strap 20 be at least several feet long. A length of between approximately 3 to 6 feet provides an advantage during rescues that are undertaken during a gun battle. When fully extended, as shown in FIG. 13, the rescue strap 20 allows a significant separation between the rescuer and the down colleague. This distance of separation allows the rescuer freer movement, to move behind cover perhaps or to a better vantage point. Freer movement of the rescuer also makes it easier for the rescuer to deploy his weapon and direct it at the enemy. The rescue strap 20 is also preferably long enough so that the rescuer can remain upright, have his weapon drawn and in one hand directed at the enemy, and pull on the ring handle 40 with the other hand to move the fallen soldier. Alternatively, the rescuing soldier can secure a carabiner-type pull ring handle 40 to some part of his own gear or clothing and pull with his body, freeing both hands as may be needed, as the rescuer quickly pulls a fallen comrade from immediate danger.

As a further feature of the vest 10, it may include a flexible expansion joint 80. As shown in FIG. 5 and FIG. 9, the expansion joint 80 is preferably positioned to run vertically and centrally along the back of the wearer. The expansion joint comprises a stretchable, flexible material integrated into the outer shell, for example by being sewn along its edges to the separated halves of the vest's back panel. The expansion joint 80 is not incorporated into any armored panels or anti-ballistic materials, so that the expansion joint 80 does not interrupt or compromise the protective integrity of the vest 10. The stretchable nature of expansion joint 80 allows the vest 10 a greater degree of flexibility. This affords the wearer of the vest 10 increased mobility, for example when extending his arms or turning his torso at the waist. Lycra spandex is one material that can be used for the expansion joint 80, though other stretchable, flexible materials are suitable. Generally, the expansion joint 80 need only be a few inches in width, between approximately one inch to six inches, to perform its function, though any width is acceptable.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. In an armored garment of the kind having a number of flexible material panels forming an outer shell enclosing bullet resistant armor panels, the improvement comprising:

a rescue strap having at least one location secured to the garment and an accessible, graspable portion available to be pulled by other than a wearer of the garment to pull and move the garment and its wearer;

wherein the rescue strap is secured to and runs across a bottom section of a rear panel of the armored garment from a first side to a second side of the rear panel, the rescue strap extending up both the first side and the second side and then across to a central area of the rear panel, the rescue strap extending up the central area of the rear panel to form a loop at a top end of the rescue strap, the loop forming the graspable portion.

2. The armored garment according to claim 1, wherein the rescue strap allows for a pulling force to be applied and distributed across the entire rear panel.

3. The armored garment according to claim 1, wherein the accessible graspable portion of the rescue strap has a handle affixed thereto.

4. The armored garment according to claim 2, wherein the handle is a pull ring.

5. The armored garment according to claim 4, wherein the ring is a carabiner.

6. The armored garment according to claim 2, further comprising an anchor strap secured to the vest and a connected with the rescue strap.

7. The armored garment according to claim 6, wherein a ring connects the rescue strap and the anchor strap and each strap forms a loop encircling a section of the ring.

8. The armored garment according to claim 6, wherein the anchor strap is a length of flexible strapping sewn to a panel forming a part of the shell of the armored garment.

9. The armored garment according to claim 8, wherein the length of flexible strapping sewn to a panel comprises a series of runs of the length of flexible strapping sewn in a substantially extended pattern across a panel forming a back section of the shell of the armored garment.

10. The armored garment according to claim 6, wherein the anchor strap is a length of flexible material connected in a pattern across an area of the garment.

11. The armored garment according to claim 10, wherein the area of the garment is a back area of the vest.

12. The armored garment according to claim 1, further comprising an opening in the rear panel of the armored garment shell, the rescue strap extending through the opening from an interior, storage location.

13. The armored garment according to claim 12, wherein the accessible, graspable portion of the rescue strap has a handle affixed thereto, the rescue strap handle being located at an exterior, accessible location when the strap is retracted into the interior, storage location.

14. The armored garment according to claim 1, wherein the outer shell includes an expansion joint of stretchable, flexible material extending along a panel of the outer shell.

15. The armored garment according to claim 14, wherein the expansion joint extends vertically along a back panel of the outer shell.

16. In an armored garment of the kind having a number of flexible material panels forming an outer shell enclosing bullet resistant armor panels, the improvement comprising:

an expansion joint of stretchable, flexible material extending along and separating portions of a panel of the outer shell, the expansion joint being secure along opposite edges to portions of the panel that it separates;

a rescue strap having at least one location secured to the garment and an accessible, graspable portion available to be pulled by other than a wearer of the garment to pull and move the garment and its wearer;

wherein the rescue strap is secured to and runs across a bottom section of a rear panel of the armored garment from a first side to a second side of the rear panel, the rescue strap extending up both the first side and the second side and then across to a central area of the rear panel, the rescue strap extending up the central area of the rear panel to form a loop at a top end of the rescue strap, the loop forming the graspable portion.

17. The armored garment according to claim 16, wherein the expansion joint extends vertically along a back panel of the outer shell.

* * * * *